US007497441B2

(12) United States Patent
Marshall et al.

(10) Patent No.: US 7,497,441 B2
(45) Date of Patent: Mar. 3, 2009

(54) ADJUSTABLE TARGET MOUNT

(75) Inventors: Thomas Marshall, Lakeshore, UT (US); Kyle Bateman, Provo, UT (US); Thomas Wright, Highland, UT (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 11/530,280

(22) Filed: Sep. 8, 2006

(65) Prior Publication Data

US 2009/0020955 A1 Jan. 22, 2009

Related U.S. Application Data

(60) Provisional application No. 60/715,360, filed on Sep. 8, 2005.

(51) Int. Cl.
*F41J 1/10* (2006.01)

(52) U.S. Cl. ..... 273/391; 273/406; 273/407

(58) Field of Classification Search ..... 273/406, 273/407, 390–392

See application file for complete search history.

(56) References Cited

U.S. PATENT DOCUMENTS

| | | | | | |
|---|---|---|---|---|---|
| 429,942 | A | | 6/1890 | McBride | |
| 631,175 | A | | 8/1899 | Parnall | |
| 879,670 | A | * | 2/1908 | Petry | 273/406 |
| 1,738,874 | A | | 12/1929 | Domingo | |
| 2,008,359 | A | | 7/1935 | Lamb | |
| 2,048,155 | A | * | 7/1936 | Armantrout | 273/407 |
| 2,104,171 | A | | 1/1938 | Schwerin | |
| 2,284,510 | A | | 5/1942 | Cates | |
| 2,372,111 | A | * | 3/1945 | Norberg | 273/407 |
| 2,538,118 | A | * | 1/1951 | Miller | 273/407 |
| 2,905,469 | A | | 9/1959 | Taylor | |
| 3,014,725 | A | | 12/1961 | Lewis | |
| 3,087,701 | A | | 4/1963 | Wallace | |
| 3,103,362 | A | | 9/1963 | Elofson | |
| 3,263,385 | A | | 8/1966 | Pauls | |
| 3,392,980 | A | | 7/1968 | Ortega | |
| 3,398,496 | A | | 8/1968 | Mischke | |
| 3,515,388 | A | | 6/1970 | Zachmeier | |
| 3,540,729 | A | * | 11/1970 | Rahberger | 273/407 |
| 3,601,353 | A | * | 8/1971 | Dale | 248/470 |
| 3,619,437 | A | | 11/1971 | McDonald, Jr. | |
| 3,914,879 | A | | 10/1975 | Taylor, III | |
| 4,029,318 | A | * | 6/1977 | Boss | 273/390 |
| 4,232,867 | A | | 11/1980 | Tate, Sr. | |
| 4,288,080 | A | | 9/1981 | Laporte et al. | |
| 4,540,182 | A | | 9/1985 | Clement | |
| 4,546,984 | A | | 10/1985 | Towle et al. | |
| 4,691,925 | A | | 9/1987 | Scholem | |
| 4,726,593 | A | | 2/1988 | Wade | |
| 4,739,996 | A | | 4/1988 | Vedder | |

(Continued)

OTHER PUBLICATIONS

Porta Target, Product Literature, Circa 2000.

(Continued)

*Primary Examiner*—Mark S Graham
(74) *Attorney, Agent, or Firm*—Bateman IP Law Group

(57) ABSTRACT

An adjustable target mount allows the height of the mount to be adjusted. Additionally, the mount is adjustable to accommodate a variety of different targets and target actuators, and may be quickly moved out of the line of fire without requiring disassembly or removal of the target mount.

21 Claims, 12 Drawing Sheets

U.S. PATENT DOCUMENTS 4,743,032 A 5/1988 Summers et al.
4,911,453 A 3/1990 Essex et al.
4,913,389 A 4/1990 McCracken
5,163,689 A 11/1992 Bateman
5,232,227 A 8/1993 Bateman
5,240,258 A 8/1993 Bateman
5,277,432 A 1/1994 Bateman
5,324,043 A 6/1994 Estrella
5,346,226 A 9/1994 Block
5,350,180 A 9/1994 Acock
5,352,170 A 10/1994 Condo et al.
5,400,692 A 3/1995 Bateman et al.
5,535,662 A 7/1996 Bateman et al.
5,598,996 A 2/1997 Rath
5,676,378 A 10/1997 West
5,811,718 A 9/1998 Bateman et al.
5,816,579 A * 10/1998 Broussard et al. ..... 273/408
5,822,936 A 10/1998 Bateman et al.
5,829,753 A 11/1998 Wiser
5,906,552 A 5/1999 Padilla
5,934,678 A 8/1999 Theissen et al.
5,947,477 A 9/1999 Turnipseed
5,967,523 A 10/1999 Brownlee
6,311,980 B1 11/2001 Sovine et al.
6,325,376 B1 12/2001 Elliott et al.
6,378,870 B1 4/2002 Sovine et al.
6,484,990 B1 11/2002 Marshall
6,502,820 B2 1/2003 Slifko
6,533,280 B1 3/2003 Sovine et al.
6,543,778 B2 4/2003 Baker
6,588,759 B1 7/2003 Bateman et al.
6,679,795 B2 1/2004 Ouimette et al.
6,761,357 B2 * 7/2004 Witt et al. ..... 273/407
6,776,418 B1 8/2004 Sovine et al.
6,808,177 B2 10/2004 Dehart
6,808,178 B1 10/2004 Sovine et al.
6,975,859 B1 12/2005 Lambert et al.
6,994,348 B2 2/2006 Lambert et al.
6,994,349 B2 2/2006 Lambert et al.
7,140,615 B1 11/2006 Sovine et al.
7,175,181 B1 2/2007 Bateman et al.
7,194,944 B2 3/2007 Lambert et al.
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
2005/0022658 A1 2/2005 Bateman et al.
2006/0208425 A1 9/2006 Lambert et al.
2006/0220318 A1 * 10/2006 Law ..... 273/407
2006/0220319 A1 10/2006 Lambert et al.
2006/0234069 A1 10/2006 Sovine et al.
2006/0240388 A1 10/2006 Marshall et al.
2006/0240391 A1 10/2006 Sovine et al.
2007/0040334 A1 2/2007 Marshall et al.
2007/0045965 A1 3/2007 Bateman et al.
2007/0069472 A1 3/2007 Lambert et al.
2007/0072537 A1 3/2007 Bateman et al.
2007/0102883 A1 5/2007 Parks et al.
2007/0114724 A1 5/2007 Bassett et al.
2007/0145688 A1 * 6/2007 Caruso ..... 273/407
2007/0235943 A1 10/2007 Bateman et al.

OTHER PUBLICATIONS

Shootrite, Tactical Training Target, published prior to Apr. 4, 2005.
U.S. Appl. No. 10/287,191, filed Nov. 4, 2002, Bateman et al.
U.S. Appl. No. 11/494,788, filed Jul. 26, 2006, Bateman et al.
U.S. Appl. No. 11/349,739, filed Feb. 8, 2006, Bateman et al.
U.S. Appl. No. 11/349,738, filed Feb. 8, 2006, Bateman et al.
U.S. Appl. No. 11/506,763, filed Aug. 18, 2006, Sovine et al.
U.S. Appl. No. 11/506,413, filed Aug. 17, 2006, Wright et al.
U.S. Appl. No. 11/530,280, filed Sep. 8, 2006, Marshall et al.
U.S. Appl. No. 11/745,077, filed May 7, 2007, Bassett et al.

* cited by examiner

ADJUSTABLE TARGET MOUNT

RELATED APPLICATIONS

The present application claims the benefit of prior U.S. Application Ser. No. 60/715,360, filed Sep. 8, 2005.

BACKGROUND OF THE INVENTION

1. The Field of the Invention

The present invention relates to an adjustable target mount. More specifically, the present invention relates to a target mount for use in a shooting range or similar facility.

2. State of the Art

Target mounts are commonly used in shooting ranges and similar facilities to hold or position bullet targets. While target mounts are available, they suffer from some limitations which make them more difficult to use. In mounting targets, it is sometimes necessary to utilize a target mount which not only attaches to the bottom of a target, but which supports the top of the target as well. Such mounts have arms which extend upwardly to secure the top of the target, and which are thus exposed to bullets. These arms are a nuisance when not in use as they may cause ricochets or may interfere with shooting at the targets which are in use and which are positioned adjacent one of these arms. It is not uncommon to have multiple different types of targets at a shooting range. These are often arranged in rows across the range. If a front row is not in use, the target mounts may partially obstruct another row further to the back. This is especially true if the targets in use are moving targets.

Additionally, it is often desirable to mount a number of targets at the same height at a shooting range. The shooting range floor, however, is often not at a consistent height, especially in outdoor shooting ranges. It is often difficult to adjust the height of available target mounts so as to provide a consistent mounting height for the bullet targets. In some cases, it is simply aesthetically pleasing to have a group of targets at a consistent height. It is also desirable to have some uniformity in target mounting heights. Some targets are mounted to a target actuator which rotates or otherwise moves the target. These targets are often ganged together so that a series of targets function together, typically operating from a common cable or rope. It this situation, it is important to have the targets mounted at a proper height so that the target actuators operate properly. However, it is not uncommon for the ground a shooting range to be uneven. It is thus further desirable to provide a target mount which is adjustable.

Additionally, it is often desirable to use targets of different sizes. If a small target is used, the top of the target may be well below the support arm which acts to hold up the top of the target. Thus, the attachment mechanism for attaching the support arm to the target may need to be replaced. It is thus desirable to provide a target mount which is easily adjusted to varying floor heights, and which is adjustable after installation to accommodate varying targets and target actuators. It is further desirable to provide a target mount which allows parts of the mount extending into the line of fire to be removed from the line of fire when not in use without requiring extensive disassembly of the mount.

SUMMARY OF THE INVENTION

It is an object of the present invention to provide an improved target mount.

According to one aspect of the present invention, a target mount having a movable support arm is provided. The support arm extends upwardly (or outwardly depending on the target's engagement with the mount) when in use to support a target. When not in use, the arm may be pivoted downwardly so as to not interfere with shooting at other targets, and so as to minimize damage to the arm. A target mount is also provided which may be formed with an attachment surface, used to attach targets or target actuators, which may be pivoted downwardly when not in use.

According to another aspect of the present invention, a target mount is provided which is easily adjusted during installation to accommodate varying shooting range conditions and mounting requirements. Standard brackets may be used in combination with steel struts which are easily cut to length during installation so as to provide a target mount which is easily adjusted to a desired height during installation.

According to another aspect of the present invention, a target mount is provided which is easily adjustable after installation to accommodate a variety of targets or target actuation mechanisms. A support arm and target mount are provided which are easily adjusted to accommodate targets of varying heights.

In accordance with another aspect of the invention, the support arm can be moved between any of a variety of positions to adjust for targets of different heights and widths.

These and other aspects of the present invention are realized in an Adjustable Target Mount as shown and described in the following figures and related description. It will be appreciated that all aspects of the invention need not be used together and should not be read into the appended claims.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The various embodiments shown accomplish various aspects and objects of the invention.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
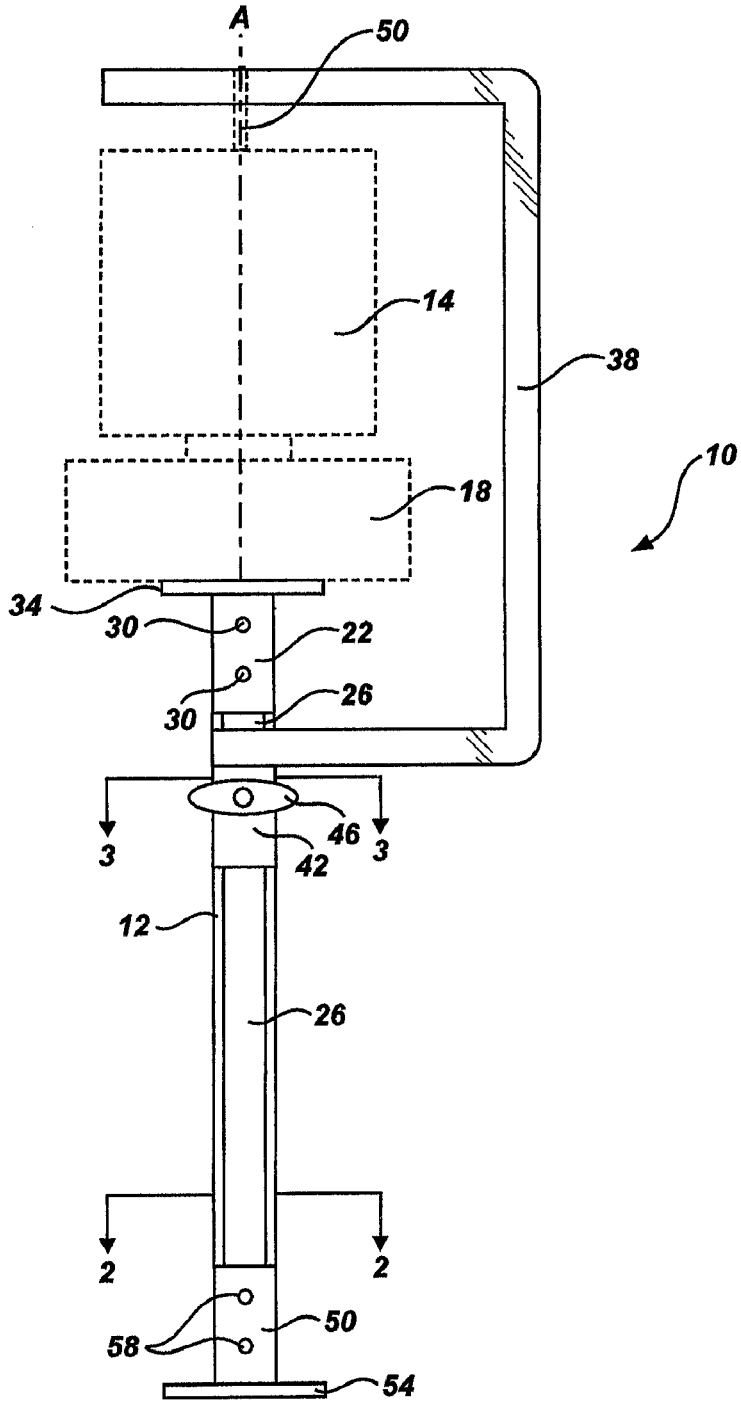
FIG. 1 shows a front view of an adjustable target mount according to the present invention.

Turning to FIG. 1, a front view of a target mount according to the present invention is shown. The target mount, indicated generally at 10, includes a base 12 configured to support a target 14 in a desired configuration. A target actuator 18 may be used, if desired, between the target 14 and base 12 so that the target 14 may be moved, such as by rotating the target 14, as may be desired. (Unless specifically noted, reference to a base can include either the base without the actuator or with an actuator.)

According to one particular use of the target mount, a target actuator 18 is used which rotates a target 14 about a axis A-A. The target 14 is rotated by ninety degrees between a position wherein the target is presented to a shooter (i.e. perpendicular to the line of fire) and a position wherein the target 14 is not presented to a shooter (i.e. parallel with the line of fire). The base 12 has an upper bracket 22 which is attached to a post 26. The bracket 22 may typically be attached to the post 26 with fasteners 30, such as bolts or screws, or may be welded or otherwise attached to the post 26 if desired. The upper bracket 22 has an attachment member 34 whereby a target actuator 18 or target 14 may be attached to the upper bracket 22. The attachment member 34 may be a steel plate which is welded to the upper bracket 22, a clamp, or may be a surface formed integrally with bracket 22 and configured for attachment to a target 14 or target actuator 18. (While discussed herein with respect to an embodiment which rotates a target about a vertical axis, it will be appreciated that the base could be rotated to support the target for rotation about a horizontal axis, could be suspended to turn the target from the top, or any desired angle in between.)

A target support arm 38 is attached to the post 26 via an arm bracket 42, and is typically welded to the arm bracket 42. Preferably, the arm bracket 42 is attached to the post 26 with a hand knob or thumb screw 46 or other attachment means which is easily adjusted without requiring the use of tools. According to a currently preferred embodiment, the hand knob 46 has a threaded section such that the knob functions as a hand operable bolt. The support arm 38 is used to support the target 14, as many bullet targets are not of sufficient thickness to remain vertical without being held from the top of the target 14. Accordingly, one or more fastening devices 50, such as an elastic, spring, string, etc. may be used to attach the target 14 to the arm 38. As will be explained in additional detail below, the support arm 38 can be moved to change the position of the end which holds the target to either adjust for different height targets, or to move the support arm 38 out of the way when it is not needed.

A lower bracket 50 is attached to the post 26 and used to support the target mount 10, and has an attachment surface 54 by which the lower bracket may be attached to the ground or another surface. The lower bracket 50 is typically attached to the post with fasteners 58, such as bolts, but may be welded or otherwise attached if desired.

It will be appreciated that the post 26, which may be a conventional steel stud or other post, may be easily cut when installing the target mount 10. This allows an individual to customize the height of the target mount 10 as necessary for a particular installation. Because of the manner of attaching the various brackets to the post 26, it is typically not necessary to drill additional holes or otherwise modify the post 26 after cutting the post. After installation, a post 26 may be further cut to shorten the target mount 10. Additionally, a new section of post 26 may be easily used to replace an existing post, making the target mount taller or replacing a damaged post.

Figure 2A:
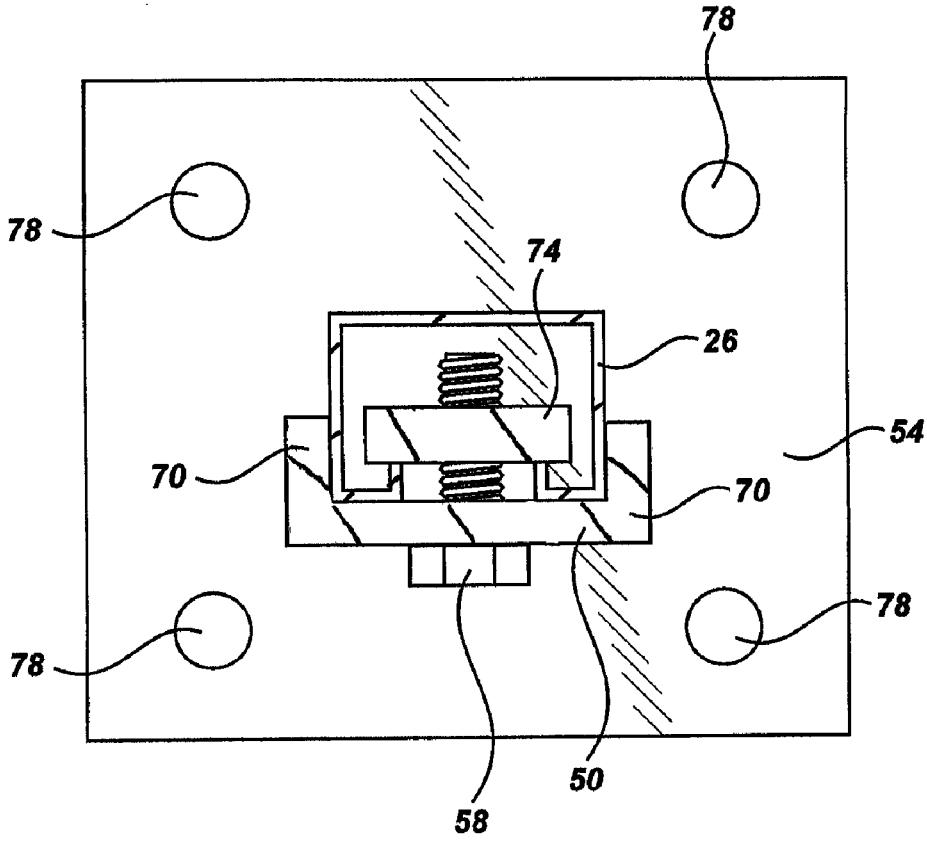
FIG. 2A shows a cross-sectional view of the target mount of FIG. 1 taken along line 2-2.

Turning now to FIG. 2A, a cross section view of the target mount of FIG. 1 taken along line 2-2 is shown. The post 26 can be more clearly seen, and is preferably selected to have a generally C-shaped cross-section as shown. The post shape shown allows an individual to easily attach the various brackets to the post 26 and to easily adjust the target mount as will be discussed. The lower bracket 50 is thus selected to engage the post 26 and inhibit movement of the post 26 relative to the bracket. Accordingly, the bracket 50 may be chosen to have a C-shaped cross-section, having side portions 70 which inhibit rotation of the lower bracket 50 relative to the post 26. Fasteners, such as bolt 58, are used to connect the bracket 50 to the post 26. A nut 74 is used with the bolt 58 to secure the bracket 50. The nut 74 may be selected so as to have a rectangular shape, as viewed from the axis of the threaded hole, which has a small dimension which fits through the opening along the face of the post 26, and a large dimension which does not fit through the opening along the face of the post 26. Such a nut is known and is produced for use with UNISTRUT® brand metal framing system. This allows an individual to insert the nut 74 through the opening and rotate the nut 74 by 90 degrees and tighten the bolt 58.

The attachment surface 54 may be a steel plate which is welded to the lower bracket 50. Alternatively, the attachment surface 54 may be formed integrally with the bracket 50, such as by cutting and bending the lower portion of the bracket 50 to form a flange. The attachment surface 54 may have holes 78 formed therein to facilitate attachment of the target mount 10 in a desired location, as may typically be accomplished by using bolts, nails, stakes, etc.

Figure 2B:
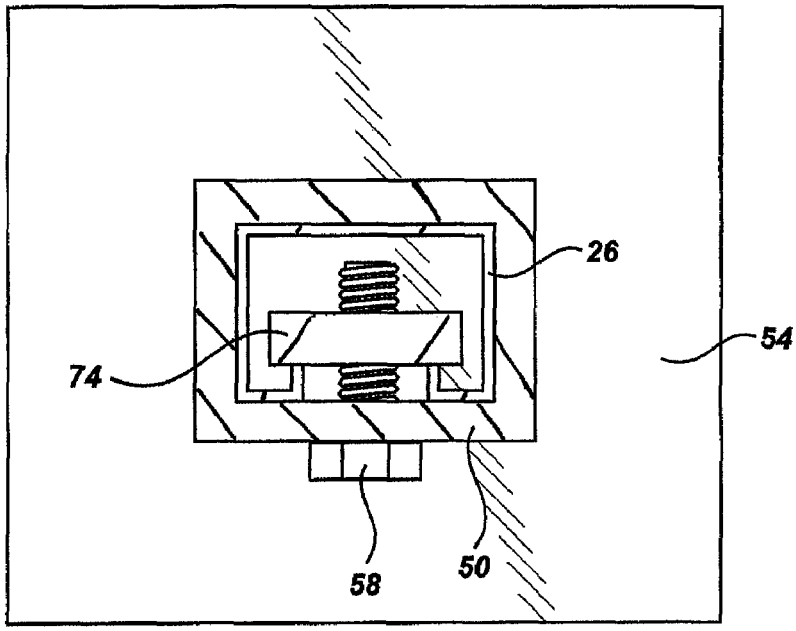
FIG. 2B shows an alternate cross-sectional view of the target mount of FIG. 1 taken along line 2-2.

Turning now to FIG. 2B, an alternate cross-sectional view of the target mount of FIG. 1 taken along line 2-2 is shown. An alternative style of lower bracket 50 is shown wherein the bracket has a square cross section. It will thus be appreciated that many configurations are possible for forming the brackets. The C-shaped bracket 50 of FIG. 2A may, however, be easier to attach to the post 26 than the square shaped bracket 50 of FIG. 2B.

Figure 3:
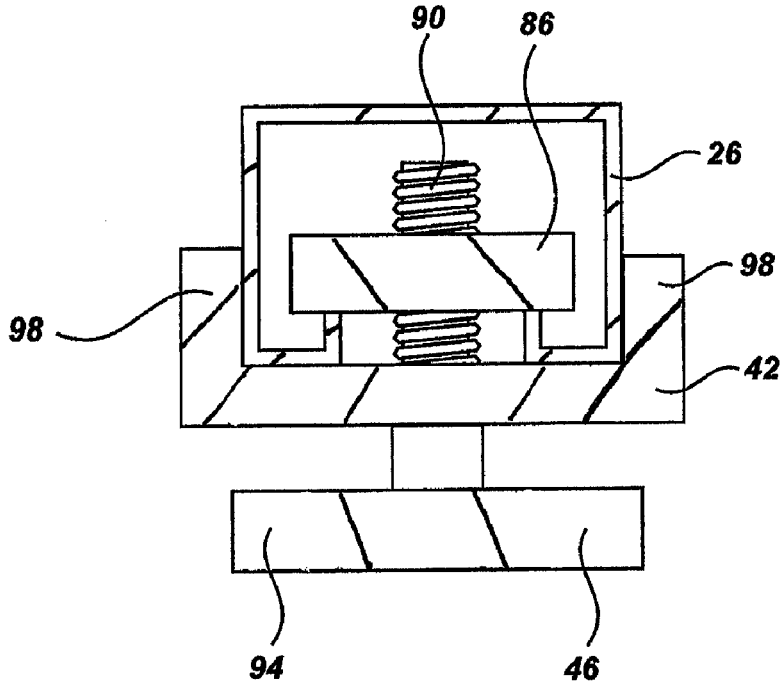
FIG. 3 shows a cross-sectional view of the target mount of FIG. 1 taken along line 3-3.

Turning now to FIG. 3, a cross sectional view of the target mount of FIG. 1 taken along line 3-3 is shown. The arm bracket 42 has a C-shaped cross section as shown so as to engage the post 26 and inhibit rotation of the arm bracket 42 when held against the post 26. A nut 86 is used in combination with the hand knob 46 (which includes threaded section 90 and handle 94) to allow an individual to attach or remove the bracket 42 without using tools. If the hand knob 46 is loosened, the arm bracket may be moved relative to the post 26. If the hand knob 46 is loosened sufficiently, the arm bracket 42 may be separated from the post until the sides 98 of the bracket 42 no longer engage the post 26, allowing the bracket to be rotated relative to the post 26.

Figure 4:
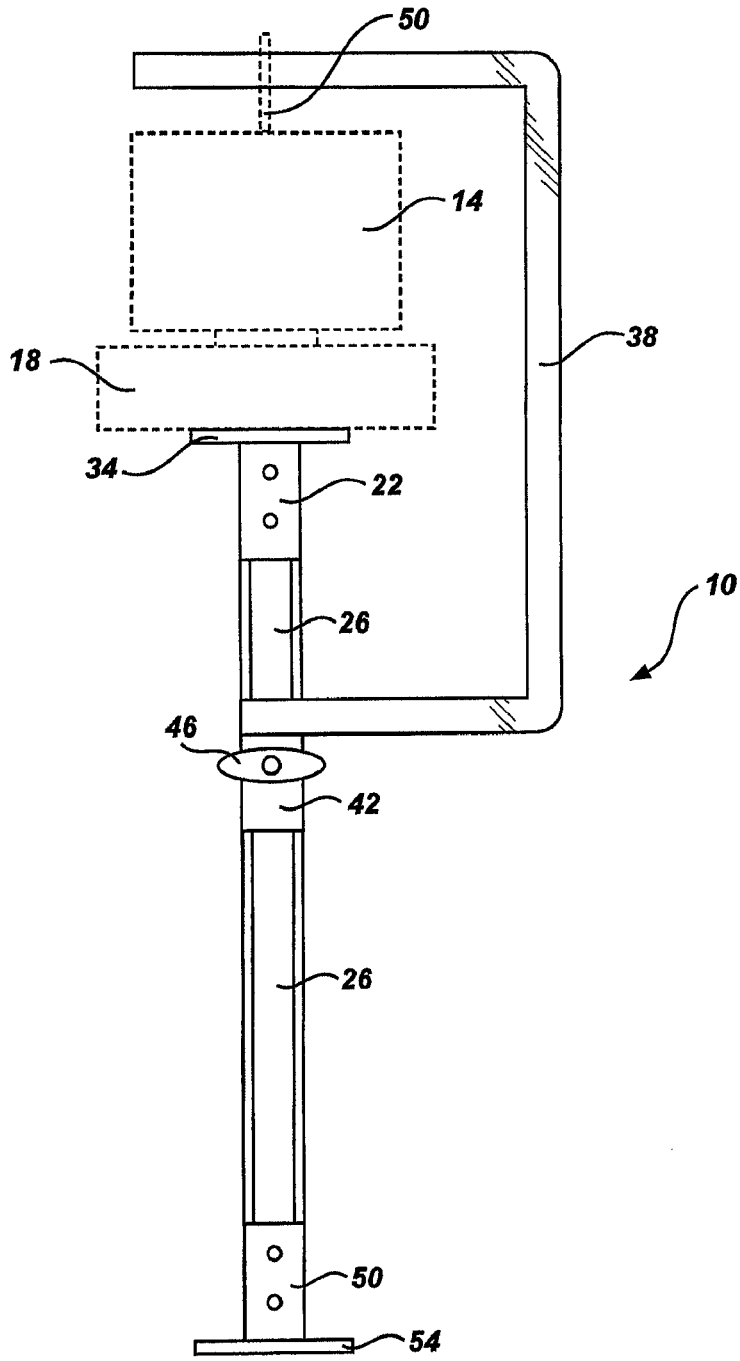
FIG. 4 shows a front view of a target mount according to the present invention.

Turning now to FIG. 4, another front view of a target mount according to the present invention is shown. The target mount 10 is similar to the target mount of FIG. 1. In viewing the target mount 10, it will be appreciated that the upper bracket 22 may be constructed in a manner similar to that of the lower bracket 50 and as shown in FIG. 2A and FIG. 2B.

FIG. 4 illustrates how the target adapter 10 is adjustable to accommodate targets 14, target actuators 18, or combinations thereof which are of varying heights. The hand knob 46 may be loosened such that the arm bracket 42 may be moved vertically relative to the post 26. This also moves the support arm 38 relative to the post 26, and thereby accommodates targets 14 and actuators 18 of different heights by moving the end of the support arm which holds the target along the axis of rotation (A-A in FIG. 1) about which the target turns. Thus the end of the support arm 14 can be moved between a first position and a second position, or between any number of positions to accommodate targets of varying heights.

It will be appreciated that if the target adaptor 10 is placed on its side, the target 14 can be made to rotate about a horizontal axis with the support arm extending horizontally outwardly. Likewise, the target adaptor 10 can be suspended to cause the support arm to extend downwardly and outwardly from the base 12.

Figure 5:
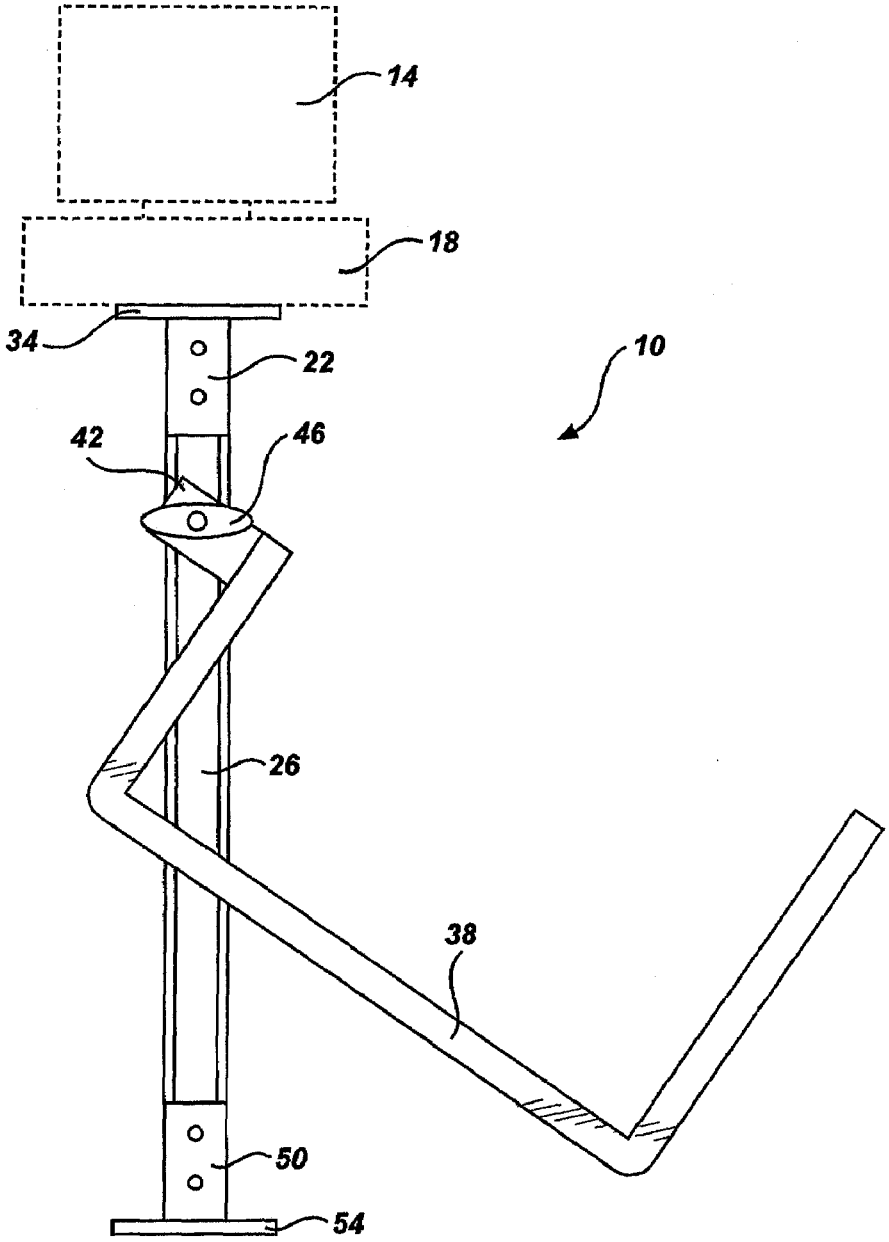
FIG. 5 shows another front view of a target mount according to the present invention.

Turning now to FIG. 5, a front view of another target mount according to the present invention is shown. The target mount 10 is similar to that of FIG. 1. The target mount 10 is not currently being used to support a target. The support arm 38 has thus been moved into a second position shown so as to remove the support arm 38 from the line of fire of other targets used on the shooting range. Movement of the support arm 38 may be accomplished by loosening the hand knob 46 sufficiently to allow the arm bracket 42 to be separated from the post until the bracket 42 no longer engages the post 26, moving the support arm 38 into the desired position, and tightening the hand knob 46 to hold the support arm 38 and arm bracket 42 in the desired position.

Figure 6:
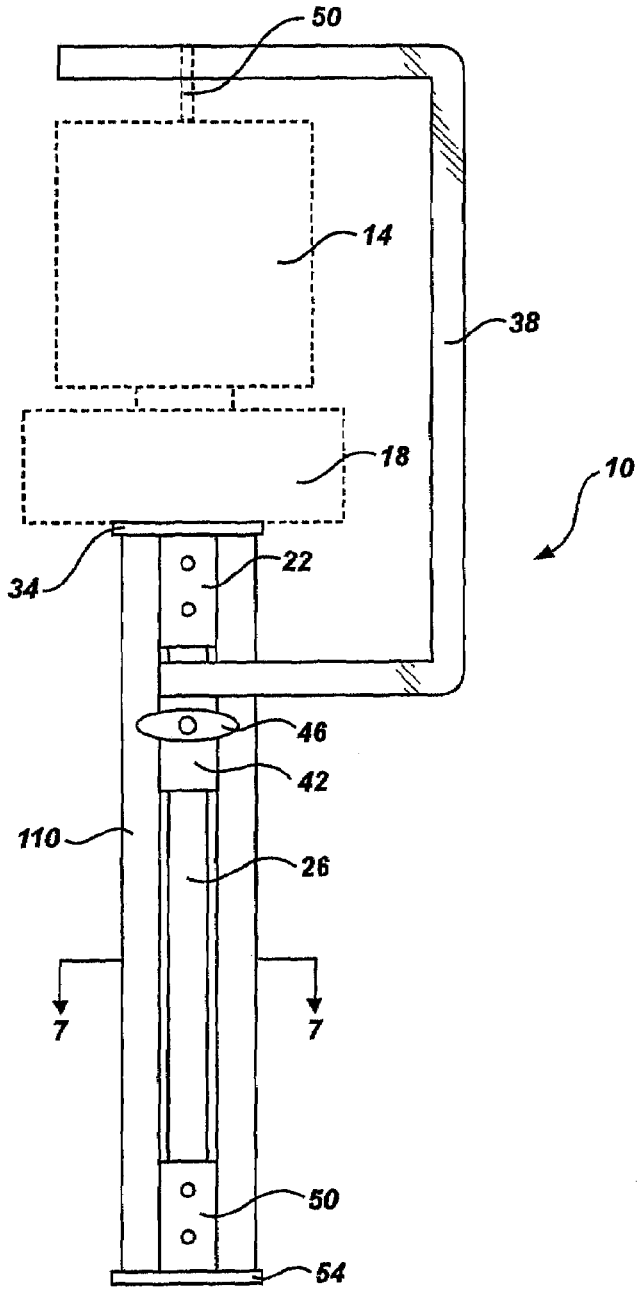
FIG. 6 shows a front view of another target mount according to the present invention.

Turning now to FIG. 6, a front view of another target mount according to the present invention is shown. The target mount 10 is similar to the mount of FIG. 1. A bullet deflector plate 110 has been attached to the target mount 10. A bullet deflector plate 110 is advantageous as it may be used to both prevent damage to the target mount 10 and to direct ricocheting bullets away from the shooter. The bullet deflector plate may be attached to the upper bracket 22 and lower bracket 50, to the post 26, to other convenient locations.

Figure 7:
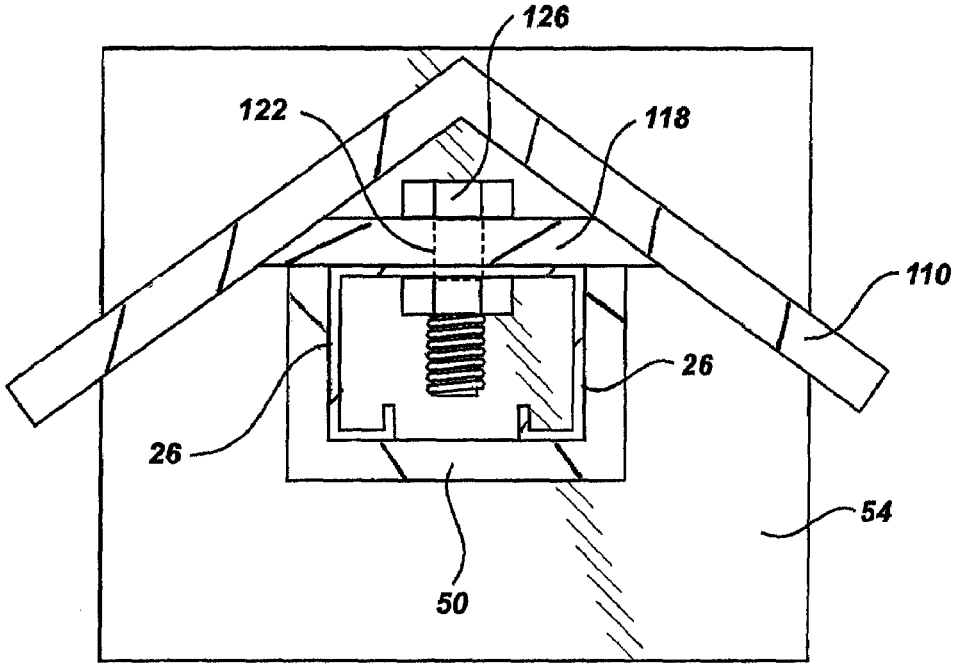
FIG. 7 shows a cross-sectional view of the target mount of FIG. 6 taken along the line 7-7.

Turning now to FIG. 7, a cross sectional view of the target mount of FIG. 6 and taken along the line 7-7 is shown. The deflector plate 110 may be fitted with a bracket 118 which facilitates attachment to the post 26, or alternatively to the upper and lower brackets 22, 50. The bracket 118 may simply be welded to the deflector plate 110. The bracket 118 may have a hole 122 formed therein whereby a bolt 126 may be used to attach the bracket 118 and deflector plate 110 to the post 26. Alternatively, the bracket 118 may simply be welded to the post 26 or upper and lower brackets 22, 50. It will be appreciated that a bullet deflector plate may be used to protect any target actuator which may be used with the target mount by similarly attaching such deflection plate to the upper portion of the post 26 or to the upper bracket 22.

Figure 8:
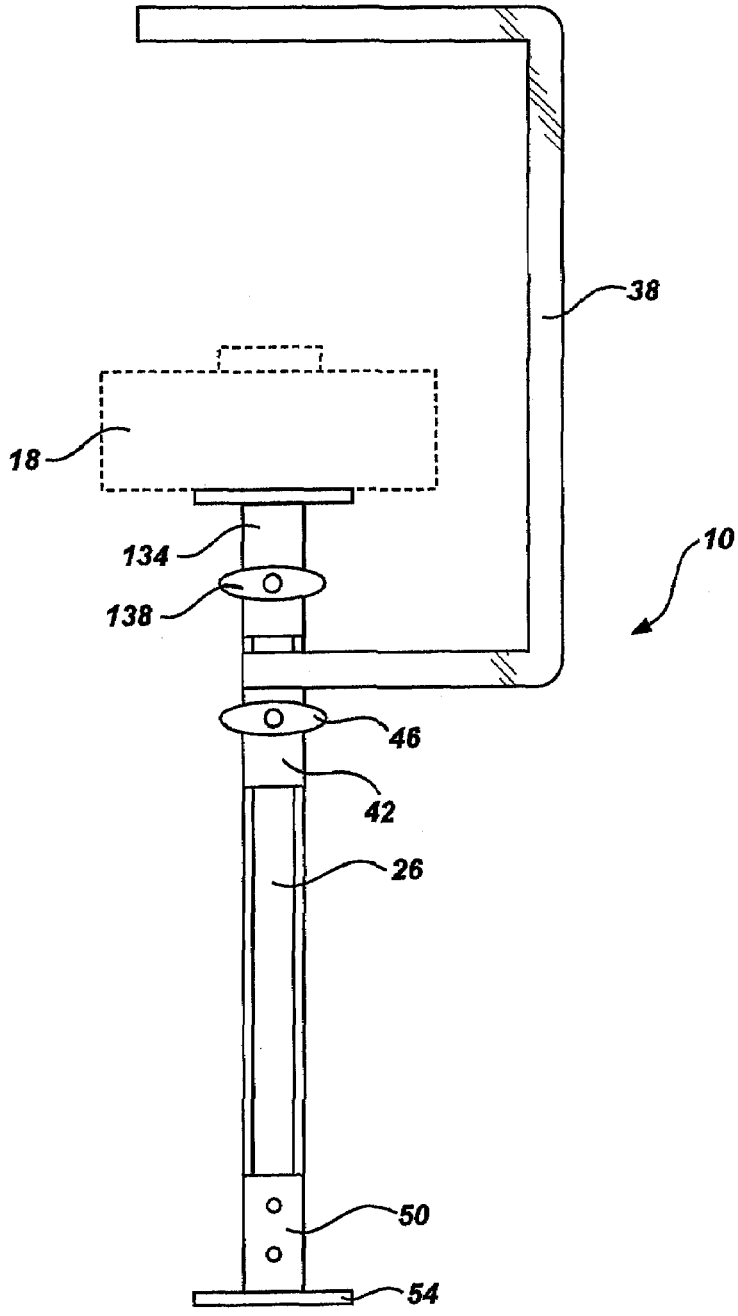
FIG. 8 shows a front view of another target mount according to the present invention.

Turning now to FIG. 8, a front view of another target mount according to the present invention is shown. The target mount 10 is formed with a lower bracket 50 and mounting plate 54, post 26, and support arm 38 with arm bracket 42 and hand knob 46 which are similar to those of FIG. 1. An upper bracket 134 has been formed in a manner similar to that of the arm bracket 42 as shown in FIG. 3 wherein the upper bracket 134 has a C-shaped cross-section and uses a hand knob 138 to attach the bracket 134 to the post 26. A mounting plate 142 is provided whereby a target (not shown) or target actuator 18 may be attached to the target base 10.

The design of the target mount 10 shown allows the support arm 38 and arm bracket 42 to be moved downwardly and out of the line of fire as shown in FIG. 5. Additionally, the upper bracket 134 may be moved downwardly and out of the line of fire by loosening the hand knob 138 sufficiently that the upper bracket 134 may be pulled away from the post 26 until the bracket 134 no longer engages the post 26. The individual may then rotate and move the upper bracket 134. This movement may also move any target actuator 18 or target (not shown) out of the line of fire.

Figure 9:
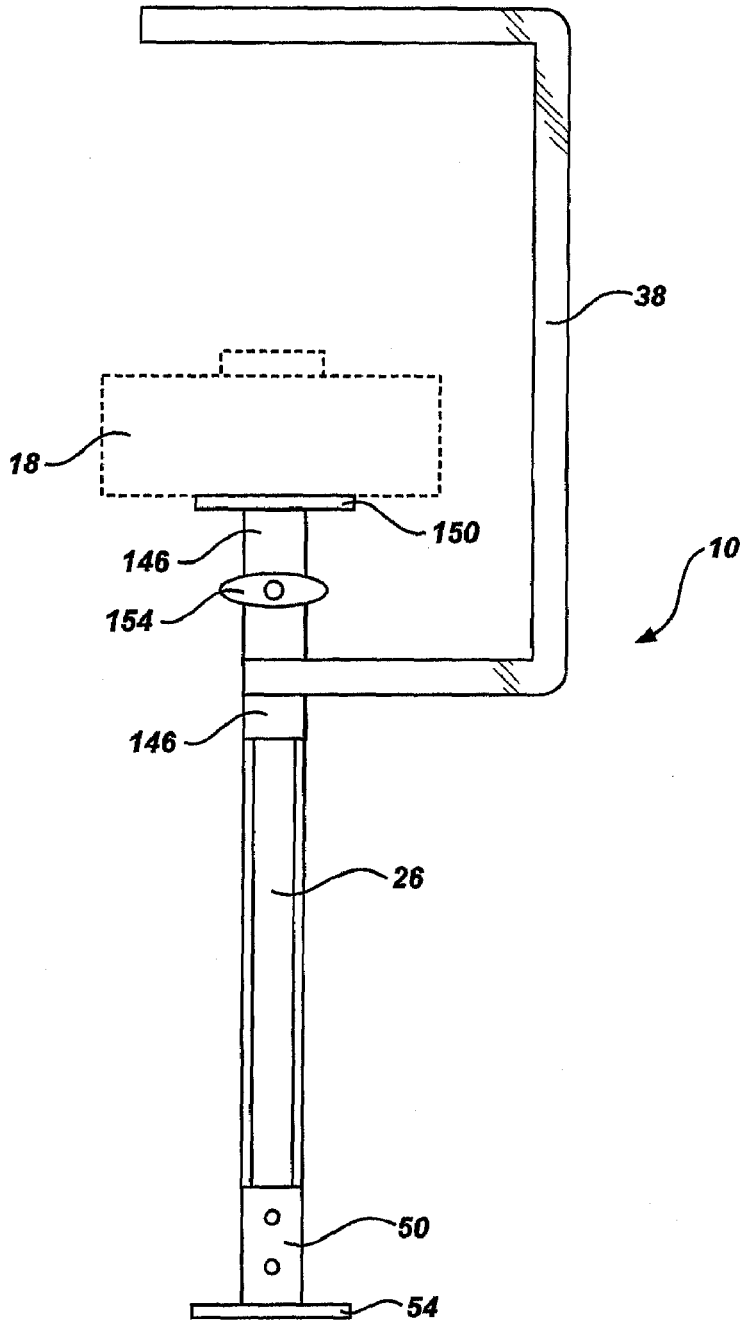
FIG. 9 shows a front view of another target mount according to the present invention.

Turning now to FIG. 9, a front view of yet another target mount according to the present invention is shown. The target mount 10 utilizes a post 26, lower bracket 50, and lower mounting plate 54 which are similar to those shown in FIG. 1. An upper mounting bracket 146 is formed similar to the mounting bracket 42 of FIG. 3, but which provides both a mounting surface 150 and is attached to a support arm 38. The mounting surface 150 may be configured for attachment to either a target (not shown) or a target actuator 18. A hand knob 154 is used to connect the upper bracket 146 to the post 26 so as to allow for adjustment of the bracket 146 without requiring tools or extensive disassembly of the target mount 10.

Figure 10:
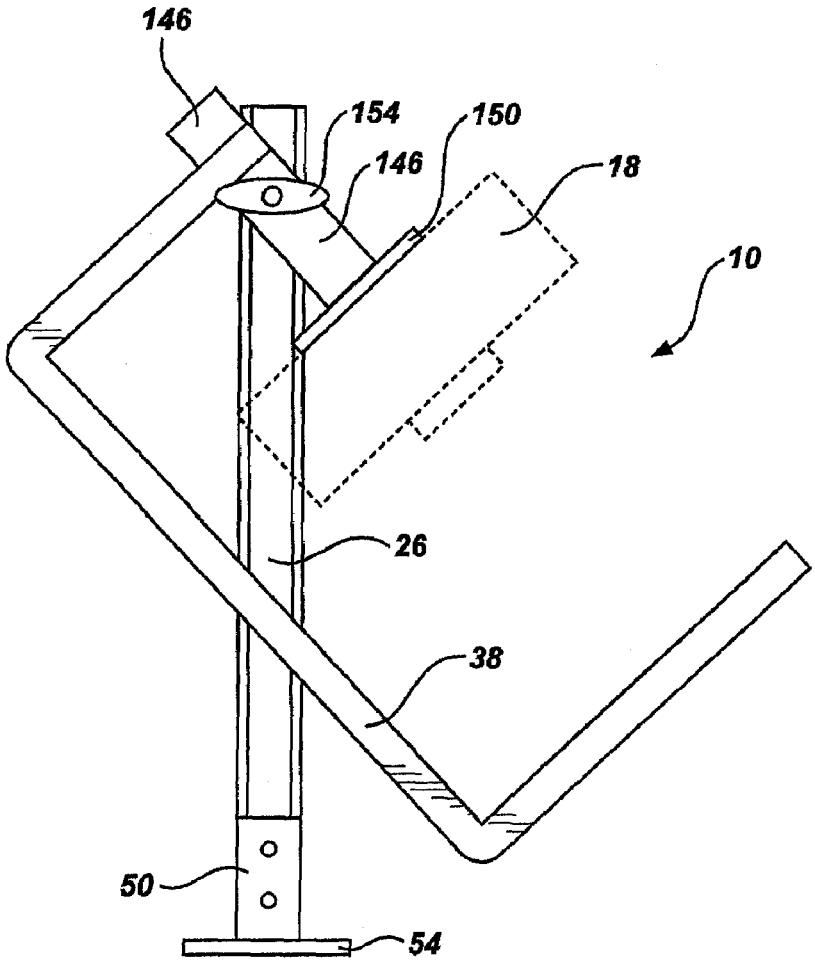
FIG. 10 shows another front view of a target mount according to the present invention.

Turning now to FIG. 10, another front view of the target mount of FIG. 9 is shown. The hand knob 154 has been loosened such that the upper bracket 146 may be disengaged from the post 26 and rotated so as to remove the actuator 18 or target (not shown) and support arm 38 from the line of fire. The hand knob may then be tightened so as to maintain the bracket 146 in the position shown.

The present invention is thus advantageous as it provides a target mount wherein the height of the target mount is easily adjusted for varying installation requirements, and wherein the height may be easily adjusted after installation. Additionally, the present invention provides a target mount which allows an individual to adjust the mount to accommodate a variety of different targets or target actuators. The individual may also easily move the target mounting and support mechanism out of the line of fire so as to reduce damage to the target mount and to minimize interference with the use of other target. This may be done quickly, without requiring disassembly of the target mount, and typically without any tools.

Figure 11:
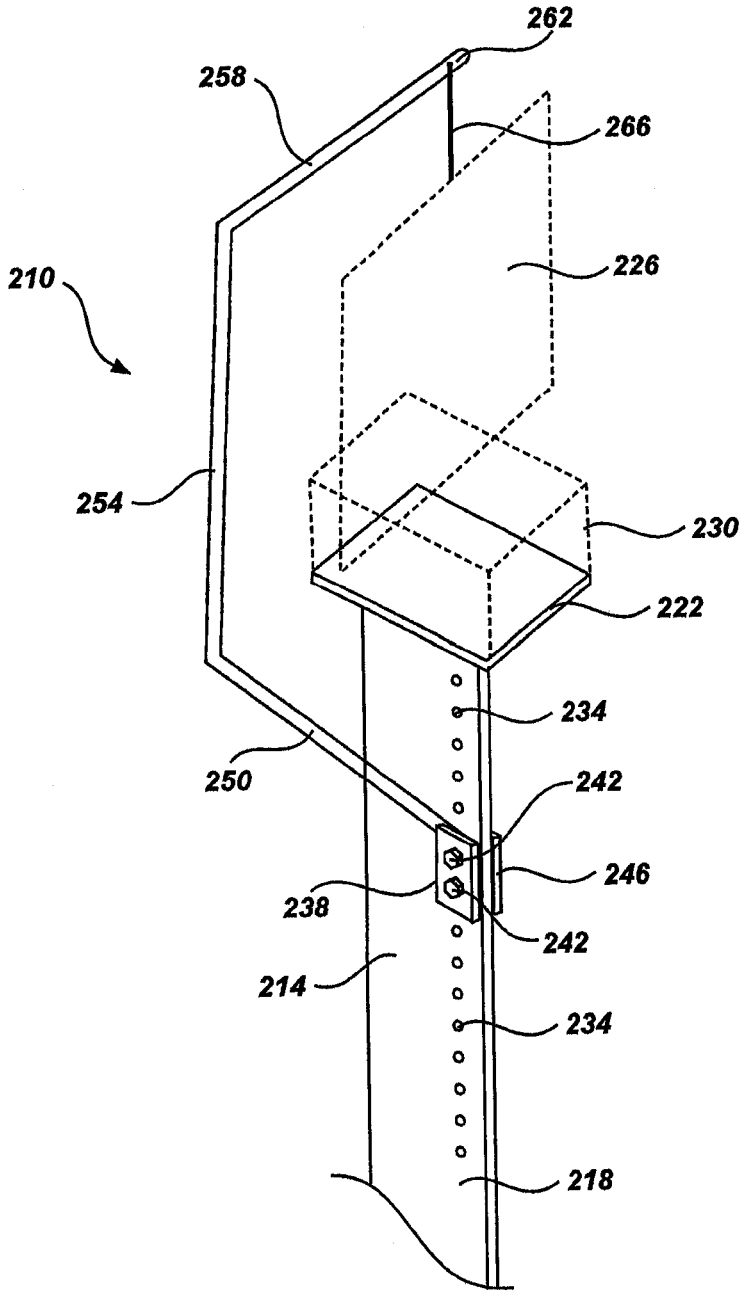
FIG. 11 shows a perspective view of yet another target mount according to the present invention.

Turning now to FIG. 11, there is shown a perspective view of an adjustable target mount formed in accordance with one aspect of the invention. A target support arm, generally indicated at 210 is attached to a target mounting base 214. The target base 214 uses a post 218, formed with a flat plate of steel and typically includes additional bracing structure and deflector plates as discussed previously and as are known in the art. The base 214 includes a bracket 222 or other means for attaching a target 226 to the base. The target 226 is often mounted to the base 214 via an actuator 230 which allows for turning and other movement of the target during use. The post 218 contains a plurality of holes 234 formed therein to facilitate attachment of the target support arm 210. The target support arm 210 is then attached to the base 214 via the holes 234.

As such, the target support arm 210 typically is formed with a flat attachment bracket 238 which is fastened to the post 218, typically by passing bolts 242 (which may be wing bolts or which may utilize wing nuts for convenience) through the bracket 238 and post 218. A backing plate 246 may be used to further secure the target support arm 210. The target support arm 210 typically is formed with a first section 250 which extends away from the base 214, a second section 254 which extends upwardly, and a third section 258 which extends back towards the base 214 so as to be above the target 226. The support arm 210 may thus form a C shape.

The target support arm 210 is adjustable as to height by attaching the target mounting arm to the post 218 at the various different holes 234, allowing the target support arm 210 to accommodate a variety of targets of differing height. The target mounting arm 210 may be removed from the base 214 when not needed.

The third section 258 of the target support arm 210 typically includes a stop structure, such as slot 262, formed therein to positively locate the line 266 or other support means which attaches the target 226 to the target support arm 210 and holds the target 226 in an upright position. The stop structure may also be a hole or notch formed in the arm or may be one or more tabs formed on the arm instead of slot 262. The stop structure is desirable as it prevents the line 266 from moving off of the end of the target support arm 210 and releasing the target 226 from the target support arm.

In constructing the target support arm 210, it is appreciated that the first section 250 and third section 258 need not extend exactly horizontally, and that the second section 254 need not extend exactly vertically. The first section 250 may extend upwardly so as to decrease the length of the second section and reduce the overall weight and amount of materials used. The third section 258 may also extend somewhat upwardly so as to provide clearance for the line 266 without greatly increasing the length of the second section 254. Additionally, the first section 250 and third section 258 may extend towards or away from the shooter or at an angle to the shooter rather than perpendicular to the shooter so as to control ricochets.

The bracket 238 and associated structures may be formed in many ways. The bracket may be formed with holes and be attached with bolts 242 to the steel plate 218. Alternatively, the bracket 238 may be formed with one or more posts which engage the holes 234 and one or more bolts 242 to hold the bracket securely to the steel plate 218. The bracket 238 may also be formed with bolts or studs which are permanently attached to the bracket and which pass through holes 234. The bracket 238 may also be formed with posts as discussed which engage the holes 234 and may have an arm which extends around to the opposing side of the steel plate 218 and a spring or other biasing means to hold the bracket against the steel plate and the posts in the holes to secure the support arm.

There is thus disclosed an improved adjustable target mount and target support arm. It will be appreciated that numerous changes may be made to the present invention without departing from the scope of the claims. The scope of the invention is not limited to any of the preceding embodiments of the invention, but is defined by the appended claims.

What is claimed is:

1. A bullet target mount comprising:

a base configured for holding a bullet target; and a target support arm, the target support arm having a first end configured for attachment to the base and a second end configured for attachment to the bullet target, the support arm being attached to the base such that the support arm is selectively movable between a first height and a second height so as to receive targets of varying height; and wherein the support arm comprises a mounting bracket disposed on the first end of the support arm and configured for engaging a face of the base, the bracket having a handscrew and at least one flange disposed thereon such that when the handscrew is tightened, the bracket is drawn against the face and the at least one flange is disposed adjacent a side of the base immediately adjacent the face so as to prevent rotation of the support arm, and such that when the handscrew is loosened the bracket may be moved away from the face such that the flange is no longer immediately adjacent the side of the base and such that the support arm may be rotated without removal from the base.

2. The bullet target mount of claim 1, wherein the base is configured for turning the bullet target about an axis of rotation and wherein the second end of the support arm is moveable along the axis of rotation between the first height and the second height.

3. The bullet target mount of claim 1, wherein the target support arm is selectively mountable to the base at a plurality of heights so as to accommodate targets of varying height.

4. The bullet target mount of claim 1, wherein the base comprises a section of steel channel, and wherein the first end of the target support arm comprises a bracket for selectively engaging the steel channel to lock the target support arm at a desired height.

5. The bullet target mount of claim 1, wherein the support arm may be rotated between a first position and a second position and selectively locked into the first and second positions.

6. The bullet target mount of claim 1, wherein the support arm is generally C-shaped so as to extend outwardly from the base, upwardly to a position above the target, and inwardly above the target.

7. The bullet target mount of claim 1, further comprising a bullet target attached to the base.

8. The bullet target mount of claim 1, further comprising a target actuator attached to the base.

9. The bullet target mount of claim 1, the base comprises an elongate post and wherein the first end of the target support arm comprises a bracket which partially encloses a section of the elongate post so as to allow selective rotation of the bracket without removal of the bracket from the elongate post.

10. The mount of claim 1, wherein the second end of the target support arm comprises a stop for limiting movement of a line which engages the target and the target support arm to hold the target in a desired position.

11. The mount of claim 10, wherein the stop comprises a slot formed in the second end of the target support arm.

12. The mount of claim 1, further comprising a bullet target attached to the base and to the target support arm.

13. The mount of claim 12, wherein the bullet target is attached to the base via a target actuator.

14. The mount of claim 3, wherein the target support arm is selectively rotatable away from the base when not in use.

15. The bullet target mount of claim 1, wherein the base comprises an upper bracket for mounting a target thereto.

16. A bullet target mount comprising:

a base;

a target actuator attached to the base, the target actuator being configured for rotating a target;

a target mount on the top of the target actuator, the target mount being configured for mounting a target thereto; and a support arm, the support arm having a first end attached to the base and a second end configured for attachment to the target on a side of the target opposite the target mount, the support arm being rotatable relative to the base between a first position wherein the second end is disposed above the target so as to be attachable to a target so as to allow rotation of the target and a second position wherein the second end is not disposed above the target and wherein the support arm is selectively attachable to the base at a plurality of positions so as to vary the height of the support arm relative to the target mount and thereby accommodate varying sizes of targets.

17. The mount of claim 16, wherein the first end of the support arm has a flange thereon configured for engaging the base when the support arm is drawn towards the base so as to prevent rotation of the support arm and selectively lock the support arm in the first position.

18. The mount of claim 17, further comprising a hand screw for selectively drawing the first end of the support arm towards the base to thereby prevent rotation of the support arm.

19. The mount of claim 16, wherein the support arm comprises a first section extending away from the base, a second section extending inwardly, and a third section extending inwardly to a position above the target.

20. The mount of claim 16, wherein the support arm rotates downwardly and to the side of the target when moving into the second position.

21. The mount of claim 20, wherein the base is generally vertical and wherein the actuator and target are mounted above the base, and wherein the second end of the support arm is disposed above the target.

* * * * *